US011333318B2

(12) United States Patent
Miao et al.

(10) Patent No.: US 11,333,318 B2
(45) Date of Patent: May 17, 2022

(54) SWITCH DISPLAY APPARATUS AND ASSEMBLING METHOD THEREOF

(71) Applicant: Shandong University of Science and Technology, Qingdao (CN)

(72) Inventors: Yongping Miao, Qingdao (CN); Weihui Liu, Qingdao (CN); Da Chen, Qingdao (CN); Bing Chen, Qingdao (CN); Junying Wei, Qingdao (CN); Kun Dai, Qingdao (CN)

(73) Assignee: Shandong University of Science and Technology, Qingdao (CN)

( * ) Notice: Subject to any disclaimer, the term of this patent is extended or adjusted under 35 U.S.C. 154(b) by 0 days.

(21) Appl. No.: 17/270,074

(22) PCT Filed: Mar. 10, 2020

(86) PCT No.: PCT/CN2020/078658
§ 371 (c)(1),
(2) Date: Feb. 22, 2021

(87) PCT Pub. No.: WO2021/155621
PCT Pub. Date: Aug. 12, 2021

(65) Prior Publication Data

US 2022/0120408 A1 Apr. 21, 2022

(30) Foreign Application Priority Data

Feb. 7, 2020 (CN) ..... 202010082100.9

(51) Int. Cl.
*F21V 5/00* (2018.01)
*F21V 19/00* (2006.01)
(Continued)

(52) U.S. Cl.
CPC ..... *F21V 5/008* (2013.01); *F21V 19/00* (2013.01); *F21V 23/001* (2013.01); *F21W 2111/00* (2013.01)

(58) Field of Classification Search
CPC ..... F21V 5/008; F21V 19/00; F21V 23/001; F21V 23/04; F21V 23/0428;
(Continued)

(56) References Cited

U.S. PATENT DOCUMENTS 4,987,279 A * 1/1991 Hirose ..... H01H 9/181 200/312
9,153,395 B2 * 10/2015 Chu ..... H01H 9/181
9,437,377 B2 * 9/2016 Ura ..... H01H 13/14

FOREIGN PATENT DOCUMENTS

CN 104779107 A 7/2015
CN 105321429 A 2/2016
(Continued)

*Primary Examiner* — Peggy A Neils
(74) *Attorney, Agent, or Firm* — Zhihua Han; Wen IP LLC

(57) ABSTRACT

Disclosed are a switch display apparatus and an assembling method thereof. The apparatus includes a display unit (1), a support unit (2), and a base unit (3) that are arranged sequentially from top to bottom. The display unit (1) includes a display device (4), a combined lens (5), and a display device and combined lens support component (6). The combined lens (5) is located above the display device (4). Both the display device (4) and the combined lens (5) are located inside the display device and combined lens support component (6). The display device and combined lens support component (6) includes a first support part (9) used for providing structural support for the combined lens (5), and a second support part (10) used for providing structural support for the display device (4).

18 Claims, 16 Drawing Sheets

(51) Int. Cl.
*F21V 23/00* (2015.01)
*F21W 111/00* (2006.01)

(58) Field of Classification Search
CPC .. F21W 2111/00; H01H 13/023; H01H 9/181; H01H 13/14; H01H 2219/066
See application file for complete search history.

(56) References Cited

FOREIGN PATENT DOCUMENTS

| | | | | | |
|---|---|---|---|---|---|
| CN | 108735098 | A | | 11/2018 | |
| EP | 0232137 | | * | 8/1987 | ..... H01H 13/70 |
| EP | 1008977 | A2 | | 6/2000 | |

* cited by examiner

SWITCH DISPLAY APPARATUS AND ASSEMBLING METHOD THEREOF

TECHNICAL FIELD

The present disclosure belongs to the field of switch display, and particularly relates to a switch display apparatus and an assembling method for the switch display apparatus.

BACKGROUND

The Chinese invention patent application with the publication number of CN104779107A discloses a borderless display apparatus. The patent document provides a small button display switch, which can realize electrical on-off control and full screen image display.

However, the borderless display apparatus provided by the patent document has the following defects:

a. In the apparatus, a lens is formed by an arc-shaped structure at an edge of a plate transparent material and partially magnifies the light at the edge of a display image, so the aberration is obvious, which is manifested as image edge distortion and chromatic dispersion, and brings the impressions of rough image, strong granular sensation, and the like to people, and thus the visual effect is poor.

b. Waterproof coating treatment is not performed in the apparatus, only an external structure has a weak waterproof effect, and relatively low-grade protection can be realized, so its application will be limited in some application scenarios (such as a place where there is water splashing near a water area) with high waterproof requirements.

c. There are many parts and components in the apparatus, so that the apparatus has the defects of complicated design, poor assembling convenience, and the like.

SUMMARY

The first objective of the present disclosure is to provide a switch display apparatus, which ensures the display effect of the edge of an image and improves the overall uniformity of a display image by means of magnifying the overall image of the display device.

To achieve the above objective, the present disclosure adopts the following technical solutions:

A switch display apparatus includes a display unit, a support unit, and a base unit that are arranged sequentially from top to bottom. The display unit comprises a display device, a combined lens, and a display device and combined lens support component. The display device is configured to provide a display image. The combined lens is located above the display device and is configured to optically magnify the overall display image and output the optionally magnified display image. Both the display device and the combined lens are located inside the display device and combined lens support component. The display device and combined lens support component includes a first support part used for providing structural support for the combined lens, and a second support part used for providing structural support for the display device. The first support part and the second support part are respectively connected to the inner side walls of the display device and combined lens support component. The support unit includes a support unit top plate and support unit side plates. At least one top plate glue groove is arranged at on the upper surface of the support unit top plate, where the top plate glue groove is strip-shaped or annular. The upper surface of the support unit top plate is connected to the bottom surface of the display device and combined lens support component. A switch cap press seat is arranged at the central position of the lower surface of the support unit top plate. A switch cap limiting groove is formed in the switch cap press seat. The base unit comprises a base body, a circuit board, a button switch, a rubber switch cap, a socket, and a connecting wire harness. The base body comprises a base body bottom plate and base body side plates. An annular glue groove is arranged at the edge of the periphery of the base body bottom plate, and the circuit board is mounted on the base body bottom plate. The button switch and the socket are respectively mounted on the circuit board. One end of the connecting wire hardness is connected to the socket, and the other end of the connecting wire hardness is connected to the lower surface of the display device. The rubber switch cap is arranged on the button switch in a sleeving manner and forms overall package for the button switch. The top end of the rubber switch cap extends into the switch cap limiting groove. At least two groups of buckle units are arranged between the support unit side plate and the base body side plate. The buckle unit includes a buckle mounted at the bottom of the support unit side plate and a clamping block mounted on the side part of the base body side plate; a bayonet for the clamping block to insert is arranged on the buckle; the length of the bayonet in the up-down direction is greater than that of the clamping block in the up-down direction. Connecting wire harness through holes are respectively formed in the support unit top plate and the bottom surface of the display device and combined lens support component.

The second objective of the present disclosure is to provide an assembling method for a switch display apparatus, so as to improve the assembling convenience of the switch display apparatus, and meanwhile, improve the protection grade of the switch display apparatus. A specific technical solution is as follows:

An assembling method for an switch display apparatus, based on the switch display apparatus, includes the following steps:

I. first, plugging one end of the connecting wire harness to the lower surface of the display device, and then, performing sealing treatment on the position where the connecting wire harness is in contact with the lower surface of the display device by using glue; II. coating the surface of the second support part with a layer of glue, and placing the display device on the surface of the second support part, so that the bottom of the display device and the surface of the second support part are connected to each other; coating the surface of the first support part with a layer of glue, and placing the combined lens on the surface of the first support part, so that the bottom of the combined lens and the surface of the first support part are connected to each other, thus the assembling of the display unit is completed; III. filling a certain amount of glue into each top plate glue groove, and then pressing the display unit on the upper surface of the support unit, so that the display unit and the support unit are connected together to form an upper assembly; IV. welding the socket and the button switch on the circuit board to form an inner assembly, and performing sealing curing treatment on each welding spot and the periphery of the button switch by using glue, and arranging the rubber switch cap on the button switch in a sleeving manner; V. plugging the other end of the connecting wire harness led out from the display device in the upper assembly after being connected in the step III into the socket in the inner assembly after being connected in the step IV, and then performing sealing treatment on a plugging position by using glue, so that the upper assembly in the step III and the inner assembly in the step IV are connected into an integrated body; VI. assembling the integrated body formed by connecting the upper assembly and the inner assembly on the base body after injecting glue into the annular glue groove; VII. pressing the top of the upper assembly and the bottom of the base unit forcibly, so that buckles are combined with clamping blocks, thereby completing an assembling process.

The present disclosure has the following advantages:

As described above, the present disclosure discloses a switch display device, which optically magnifies an image output by a display device and outputs the optionally magnified display image, so that a full screen display effect may be achieved, and the image display uniformity is good. In addition, the combined lens also has aberration compensation and correction functions, so a comfortable image display effect may be achieved. In addition, the present disclosure further provides an assembling method for a switch display apparatus, which is beneficial to improving the assembling convenience of the switch display apparatus of the present disclosure, and in addition, can also improve the protection grade of the switch display apparatus through specific assembling steps. The assembling method provided by the present disclosure effectively reduces the assembling difficulty of the switch display apparatus, so as to improve the assembling efficiency of the apparatus.

DESCRIPTION OF THE EMBODIMENTS

The present disclosure will be further described in detail below with reference to the accompanying drawings and specific implementation manners:

Embodiment 1

As shown in FIG. 1 to FIG. 5, Embodiment 1 of the present disclosure describes a switch display apparatus. The apparatus includes a display unit 1, a support unit 2, and a base unit 3 that are arranged sequentially from top to bottom. Where, the display unit 1 is used for realizing an image display function. The support unit 2 mainly provides a structure bearing function, including the bearing of the display unit 1 and the base unit 3. The function of the base unit 3 is to provide an electrical connection interface for the interior and the exterior of the switch display apparatus. In addition, the base unit 3 further provides the functions of switch on-off control, stroke control, and the like. Specific structures of various units above are further described in detail below.

Figure 1:
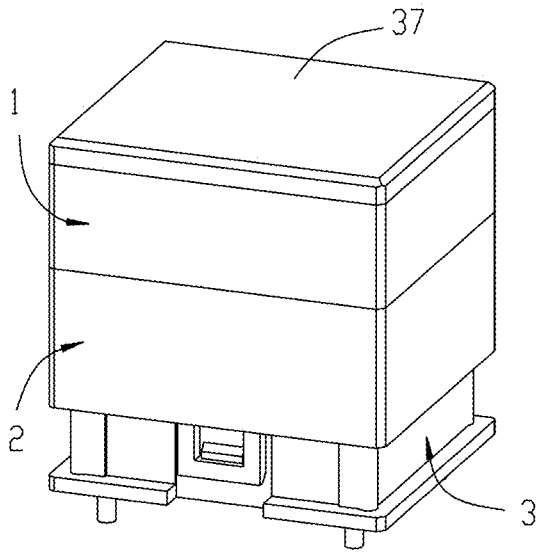
FIG. 1 is a schematic structural diagram of a switch display apparatus in Embodiment 1 of the present disclosure.
Figure 2:
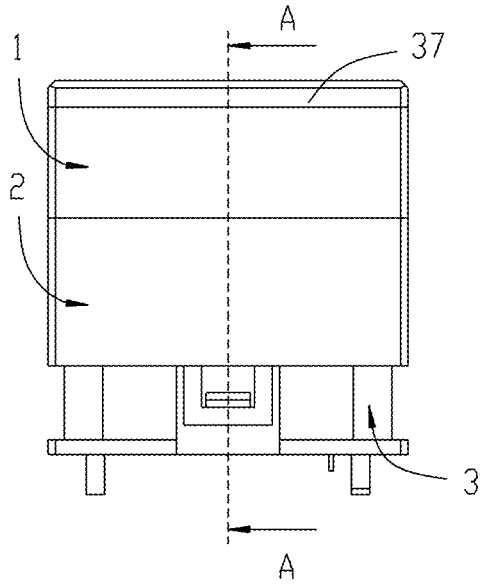
FIG. 2 is a main view of the switch display apparatus in Embodiment 1 of the present disclosure.
Figure 3:
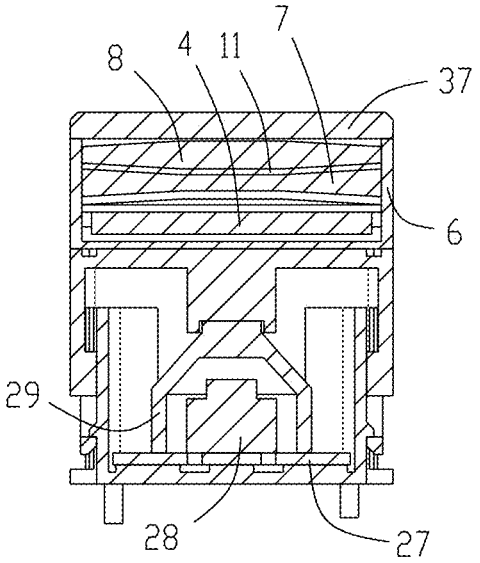
FIG. 3 is an A-A directional section view of the switch display apparatus in FIG. 2.
Figure 4:
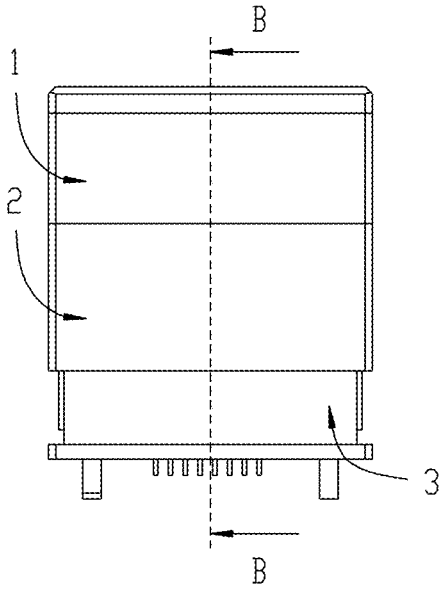
FIG. 4 is a side view of the switch display apparatus in Embodiment 1 of the present disclosure.
Figure 5:
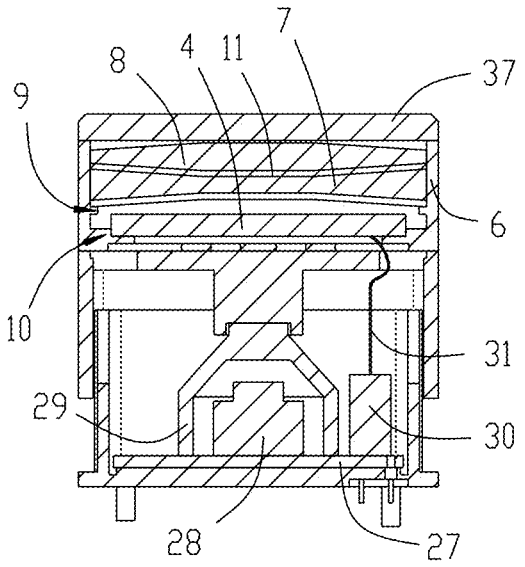
FIG. 5 is a B-B directional section view of the switch display apparatus in FIG. 4.

As shown in FIG. 3 and FIG. 5, the display unit 1 includes a display device 4, a combined lens 5, and a display device and combined lens support component 6. Where, the display device 4 is used for outputting a display image. The display device 4 in the present embodiment may adopt a plane display screen, for example, a liquid crystal display screen or an LED display screen. The combined lens 5 is located above the display device 4, and its function is that, after the display device 4 outputs a display image, the combined lens 5 may optically magnify the overall display image and output the optionally magnified image. In addition, the combined lens 5 also has aberration compensation and correction functions, so as to achieve a full screen and comfortable image display effect.

Figure 26:
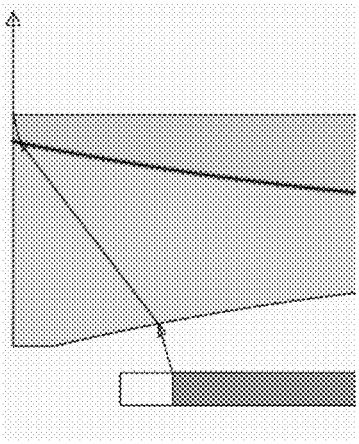
FIG. 26 is an optical path display schematic diagram in the embodiments of the present disclosure.

The present embodiment is beneficial to improving the overall uniformity of image display, avoiding distortion and chromatic dispersion at an edge of an image to bring impressions of rough image, strong granular sensation, and the like to people, thereby improving the visual display effect. As a preferred manner, the combined lens 5 includes a concave lens 7 and a convex lens 8, where the concave lens 7 is located above the display device 4, and the convex lens 8 is located above the concave lens 7. Its optical path is as shown in FIG. 26, and an optical principle is that: the light emitted from the display device 4 diffuses to the periphery after passing through the concave lens 7, and the display image is also enlarged to the periphery; then the light is changed into collimated light after passing through the convex lens 8, so that the image viewed when human eyes view vertically from top to bottom is an enlarged image.

Figure 6:
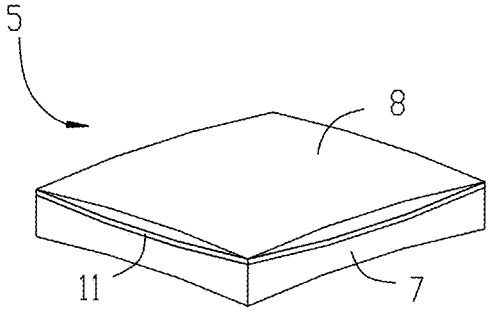
FIG. 6 is a structural schematic diagram of a combined lens in Embodiment 1 of the present disclosure.
Figure 29:
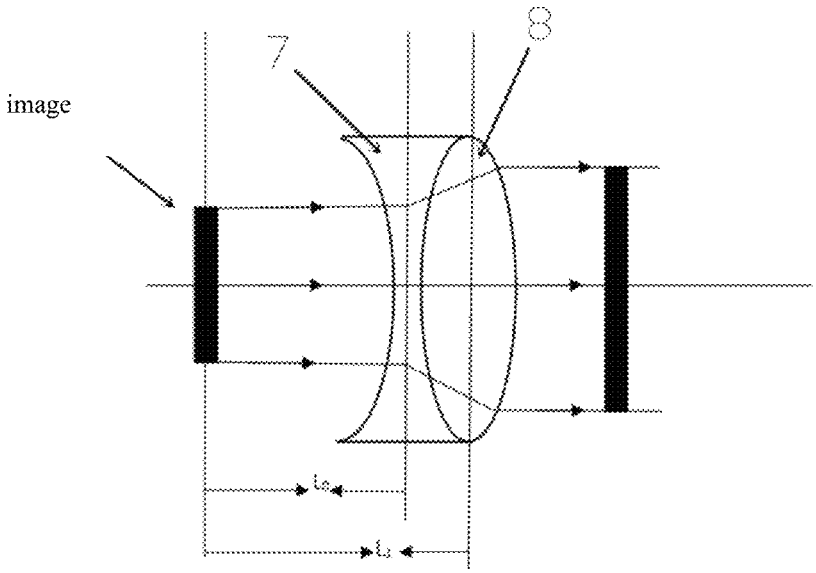
FIG. 29 is a schematic diagram of an optical principle of a combined lens in Embodiment 1 of the present disclosure.

Embodiment 1 provides a combined structure form of the concave lens and the convex lens as shown in FIG. 6, that is: the concave lens 7 adopts a biconcave lens, and the convex lens 8 adopts a biconvex lens. Both the display device 4 and the combined lens 5 are located inside the display device and combined lens support component 6. The display device and combined lens support component 6 is used for providing related mounting structures for the display device 4 and the combined lens 5. The optical principle of a magnifying effect of the combined lens 5 is illustrated in FIG. 29. The image displayed by the display device 4 is magnified after passing through the combined lens 5. The concave lens 7 and the convex lens 8 have the same optical axis. L0 is the distance from the display image to the concave lens 7, and $L_1$ is the distance from the display image to the convex lens 8. According to the optical principle, the magnification power β is: $\beta=L_1/L_0$. The optical principle of a spherical aberration weakening effect of the combined lens 5 is illustrated in FIG. 30.

Figure 30:
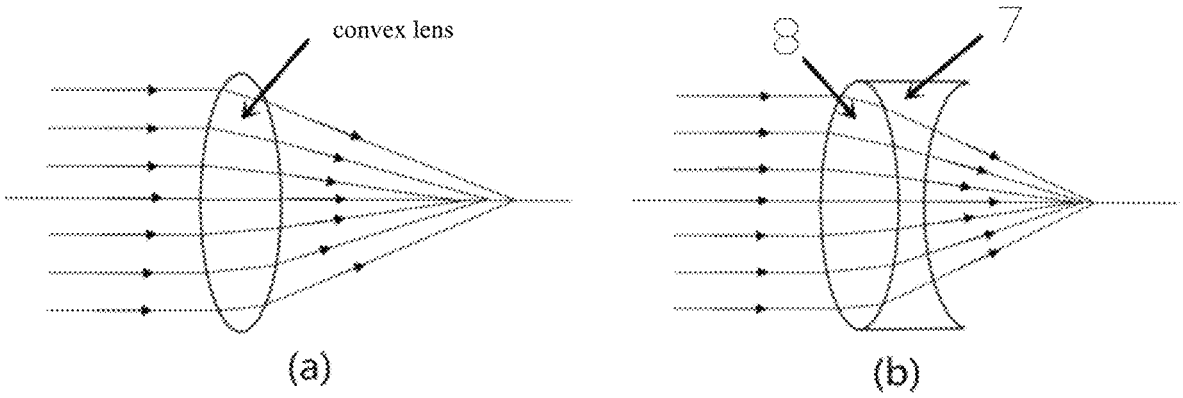
FIG. 30 is a schematic diagram of an optical principle of a spherical aberration weakening effect of the combined lens in Embodiment 1 of the present disclosure.

Parallel light in FIG. 30(*a*) converges after passing through a convex lens, and due to the existence of the spherical aberration of the lens, the light may not converge to a point but form a round diffusion spot, which is manifested as an edge and corner area with a rough and fuzzy image on the displayed image. In a combined design solution adopting a convex lens and a concave lens in the present embodiment, as shown in FIG. 30(*b*), the parallel light converges on a point that is relatively close to an optical axis after passing through the convex lens 8 and the concave lens 7. According to the principle of reversibility of light, it can be known that the lens combination designed by the present disclosure has an effect of effectively weakening the spherical aberration. The optical principle of a spherical aberration weakening effect of the combined lens 5 is illustrated in FIG. 31.

Figure 31:
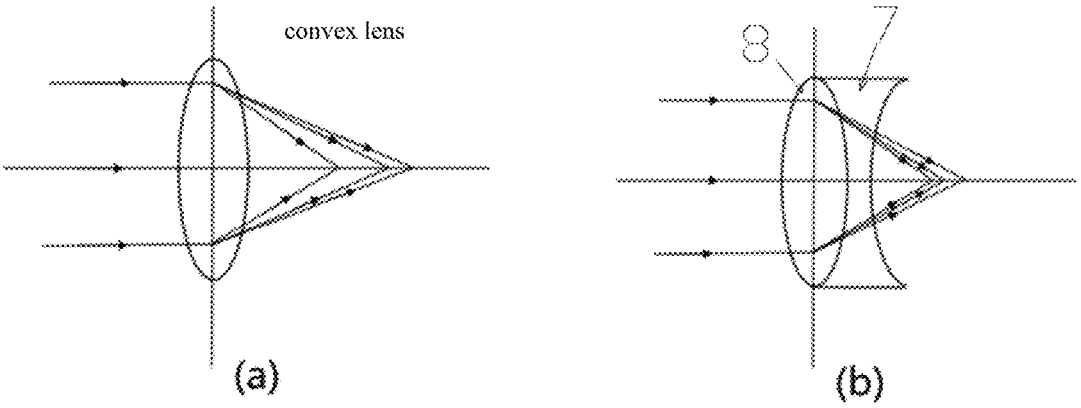
FIG. 31 is a schematic diagram of an optical principle of a chromatic aberration weakening effect of the combined lens in Embodiment 1 of the present disclosure.

In FIG. 31(*a*), a beam of parallel white light (composed of monochromatic light with multiple wavelengths) converges after passing through a convex lens, and due to the chromatic aberration of the lens, the light with different wavelengths converges on different points of the optical axis, that is to say, separated colors are represented instead of a white light spot, which is manifested as chromatic dispersion, namely, color separation, on the display image. In FIG. 31(*b*), after a beam of parallel white light passes through the convex lens 8 and the concave lens 7, color light with different wavelengths converges on a point that is relatively close to the optical axis. According to the principle of reversibility of light, it can be known that the lens combination designed by the present disclosure has an effect of effectively weakening the chromatic dispersion. As shown in FIG. 5, the display device and combined lens support component 6 includes a first support part 9 and a second support part 10. Where, the first support part 9 is used for supporting the combined lens 5, and the second support part 10 is used for supporting the display device 4. In the present embodiment, the first support part 9 may provide independent support for the concave lens 7 and the convex lens 8.

Figure 7:
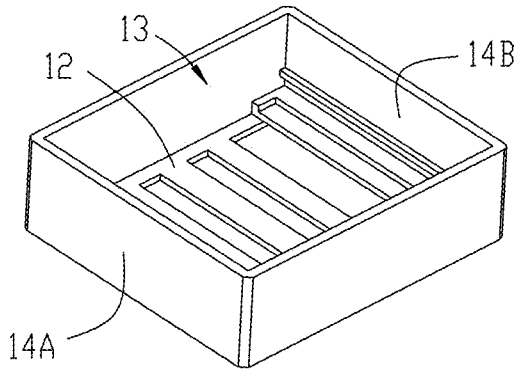
FIG. 7 is a structural schematic diagram of a display device and combined lens support component in Embodiment 1 of the present disclosure.
Figure 9:
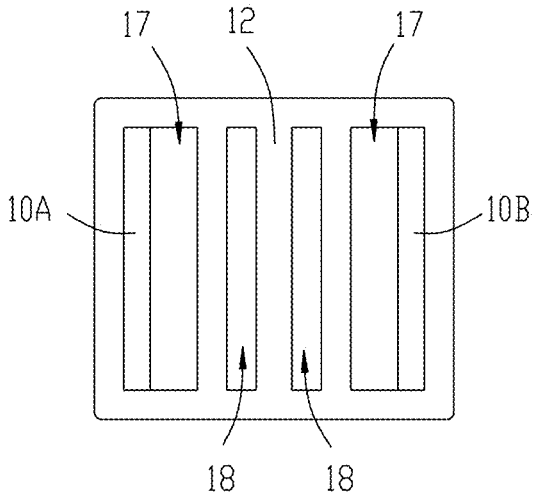
FIG. 9 is an upward view of the display device and combined lens support component in Embodiment 1 of the present disclosure.

Of course, in consideration of the miniaturization design of the product and the assembly convenience of the product, the combined lens 5 is preferably designed as a glued lens, that is, an optical adhesive layer 11 is arranged between the concave lens 7 and the convex lens 8 to realize the connection between the concave lens 7 and the convex lens 8. The upper surface of the optical adhesive layer 11 is connected to the lower surface of the convex lens 8, and the lower surface of the optical adhesive layer 11 is connected to the upper surface of the concave lens 7. The first support part 9 preferably provides structural support for the overall combined lens 5 (the concave lens 7 and the convex lens 8). The first support part 9 and the second support part 10 are respectively connected to inner side walls of the display device and combined lens support component 6, so as to realize the mounting of the first support part 9 and the second support part 10. The first support part, the second support part, and the display device and combined lens support component are preferably integrally machined and formed. As shown in FIG. 7 and FIG. 9, the display device and combined lens support component 6 is preferably of a square structure, correspondingly, the components, such the display device 4 (a light emitting surface) and the combined lens 5, are also of square structures.

Figure 8:
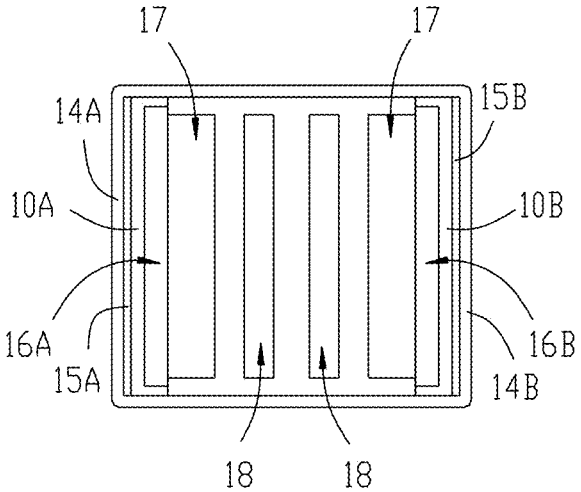
FIG. 8 is a vertical view of the display device and combined lens support component in Embodiment 1 of the present disclosure.

Of course, the display device and combined lens support component 6 may also be designed as a round shape. The shape of the display device and combined lens support component 6 is related to the shapes of the parts, such as the display device 4 (the light emitting surface) and the combined lens 5. As shown in FIG. 7, the display device and combined lens support component 6 includes a support part bottom plate 12 and a support part side plate 13, wherein the support part side plate 13 consists of four side plates that are connected sequentially. The first support part 9 may adopt a support strip structure, that is to say, the first support part 9 includes two support strips, 15A and 15B respectively. It can be seen from FIG. 5, the cross sections of the support strips 15A and 15B are preferably square. As shown in FIG. 7 and FIG. 8, the support strips 15A and 15B are arranged on a group of opposite side plates, for example, side plates 14A and 14B. Specifically, the support strip 15A is arranged on the side plate 14A, and the support strip 15B is arranged on the side plate 14B.

The edges of a group of opposite sides (such as a left side and a right side) of the lower side of the combined lens 5 are respectively located on the upper surfaces of the support strips 15A and 15B (fit each other), and the combined lens 5 is connected to the support strips 15A and 15B by using glue. To ensure the contact effect between the combined lens 5 and the support strips 15A and 15B, a section of flat surface is designed on connecting edges (for example, a left side and a right side) of the lower surface of the concave lens 7. The extension direction of the section of the flat surface is the same as that of the support strips. As shown in FIG. 7 and FIG. 8, the second support part 10 may adopt a support groove structure, that is to say, the second support part 10 includes a first block support part 10A and a second block support part 10B, and the cross sections of the two block support parts are also square. The first block support part 10A is mounted on the side plate 14A, and the second block support part 10B is mounted on the side plate 14B. The first block support part 10A is parallel to the second block support part 10B. A display device limiting groove 16A is formed in the first block support part 10A, and a display device limiting groove 16B is formed in the second block support part 10B. The limiting groove 16A is formed opposite to the limiting groove 16B. The limiting groove 16A and the limiting groove 16B preferably adopt C-shaped structures. The opposite two end parts (for example, a left end part and a right end part) of the display device 4 are respectively located in the limiting grooves 16A and 16B, and are connected to each other through glue. The sizes and distance of the limiting groove 16A and the limiting groove 16B are designed to ensure that the two end parts (the left end part and the right end part) of the display device 4 are just placed into the limiting grooves 16A and 16B to prevent the display device 4 from sliding in a front-back or left-right direction. Of course, the first support part 9 may also adopt the support groove structure as shown in the second support part 10 above, similarly, the second support part 10 may also adopt the support strip structure as shown in the first support part 9 above, and various cases are not repeated herein one by one. Because the display device 4 (the light emitting surface), the combined lens 5, and the display device and combined lens support component 6 may also be designed as round shapes, the support part side plate 13 may also be designed into a cylindrical side plate.

In this case, the first support part 9 may still adopt a support strip structure. The support strip is not a straight support strip as mentioned above, but an annular support strip that surrounds the support part side plate 13 for a circle. The edge of the lower side of the combined lens 5 is located on the surface of the support strip. In a similar way, the second support part 10 may still adopt a support groove structure. Different from the block support part above, the second support part 10 adopts an annular support part, and an annular support groove is formed in the upper surface of the annular support groove. The edge of the display device 4 is located in the annular support groove (in contact with each other), and is connected to the annular support groove through glue.

As shown in FIG. 8, connecting wire harness through holes 17 are further formed in the support part bottom plate 12, the connecting wire harness through holes 17 facilitate a connecting wire harness 31 led out from the base unit 3 to pass through and be connected to the lower surface of the display device 4. The connecting harness through holes 17 are preferably two and are symmetrically formed to facilitate mounting. In addition, to reduce the weight of the display device and combined lens support component 6, a hollow design is further performed on the support part bottom plate 12 in Embodiment 1, for example, through holes 18 are designed in the support part bottom plate 12.

Figure 10:
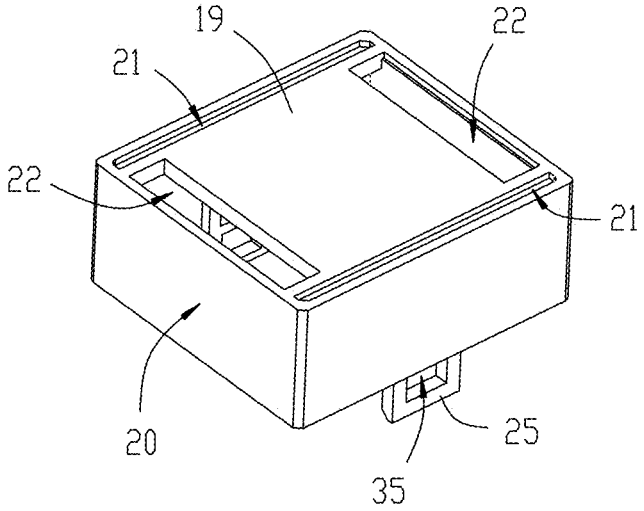
FIG. 10 is a schematic structural diagram of one side of a support unit in Embodiment 1 of the present disclosure.

As shown in FIG. 10 to FIG. 13, the support unit 2 includes a support unit top plate 19 and support unit side plates 20. Where, the support unit 2 is preferably square, of course, may also be designed as a circular structure. The upper surface of the support unit top plate 19 is connected to the bottom surface of the display device and combined lens support component 6 (namely, the lower surface of the support part bottom plate 12), and the connecting manner, for example, is gluing connection. As shown in FIG. 10, top plate glue grooves 21 used for filling glue are formed in the upper surface of the support unit top plate 19. The top plate glue grooves 21, for example, are strip-shaped grooves.

The top plate glue grooves 21 are adjacent to the positions of the corresponding edges of the support unit top plate 19, and keep a certain distance from the corresponding edges. The objective of the design of the top plate glue grooves 21 is to facilitate the connection between the support unit top plate 19 and the support part bottom plate 12. Specifically, glue is added into the top plate glue grooves 21, and then the display unit 1 is directly pressed on the support unit 2. The connection manner above is easy to operate, the connection effect is good, and a phenomenon of glue overflowing is effectively avoided.

Of course, the support unit top plate 19 in the present embodiment may also be circular, the top plate glue grooves 21 may also be designed as an annular groove, and quick connection between the display unit 1 and the support unit 2 may also be realized by adding glue into the annular groove. Connecting wire harness through holes 22 are further formed in the support unit top plate 19, which facilitates a connecting wire harness 31 led out from the base unit 3 to pass through. In the present embodiment, the connecting harness through holes 22 are preferably two and are symmetrically formed to facilitate mounting. A switch cap press seat 23 is arranged at the central position of the lower surface of the support unit top plate 19, and the switch cap press seat 23 is protruded downward from the surface on which it is located (namely, the lower surface of the support unit top plate 19).

The effect of the switch cap press seat 23 is to apply a certain pressure to a rubber switch cap 29.

Figure 11:
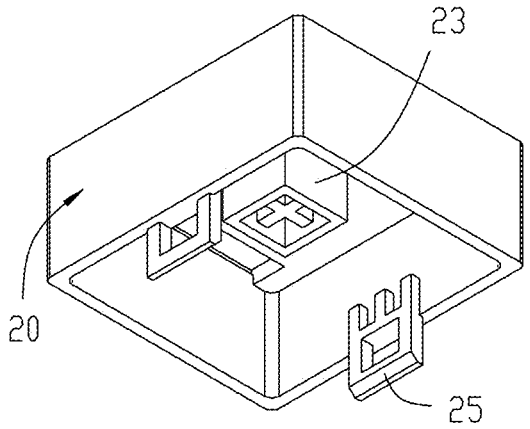
FIG. 11 is a schematic structural diagram of the other side of the support unit in Embodiment 1 of the present disclosure.
Figure 12:
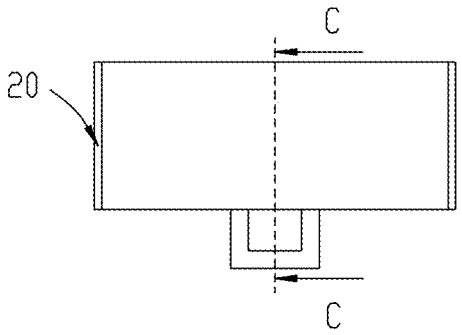
FIG. 12 is a front view of the support unit in Embodiment 1 of the present disclosure.
Figure 13:
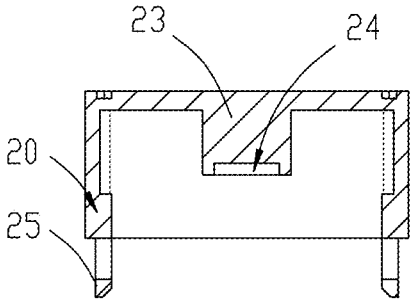
FIG. 13 is a C-C directional section view of the support unit in FIG. 12.
Figure 16:
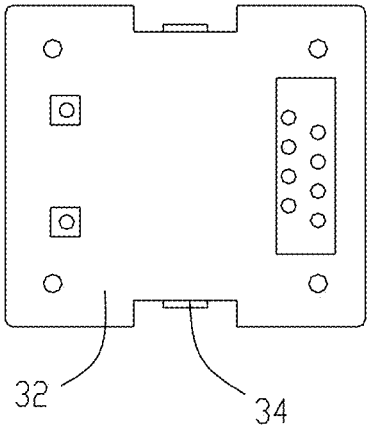
FIG. 16 is an upward view of the base unit in Embodiment 1 of the present disclosure.
Figure 17:
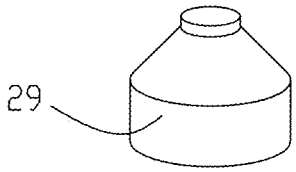
FIG. 17 is a schematic structural diagram of a rubber switch cap in Embodiment 1 of the present disclosure.
Figure 18:
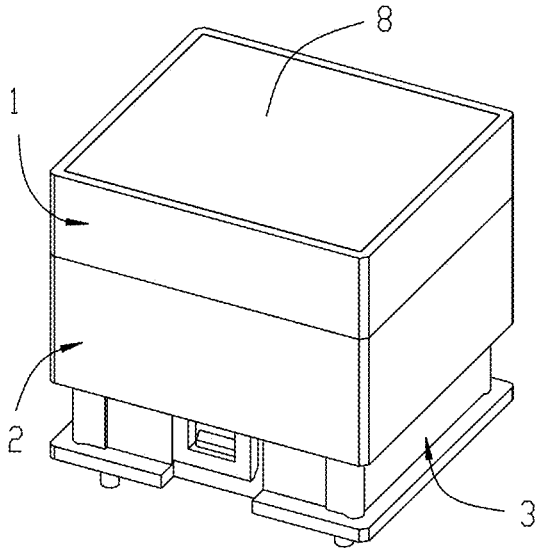
FIG. 18 is a schematic structural diagram of a switch display apparatus in Embodiment 2 of the present disclosure.
Figure 19:
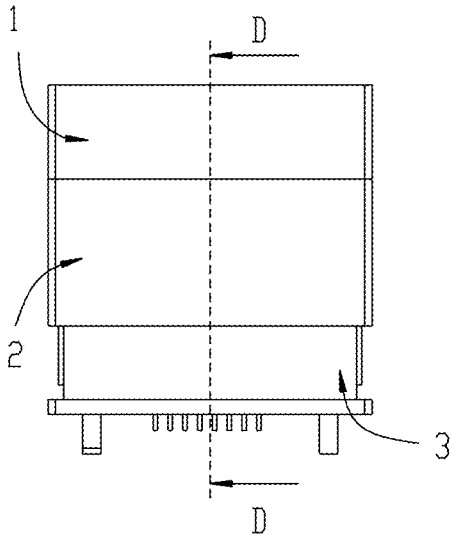
FIG. 19 is a side view of the switch display apparatus in Embodiment 2 of the present disclosure.
Figure 20:
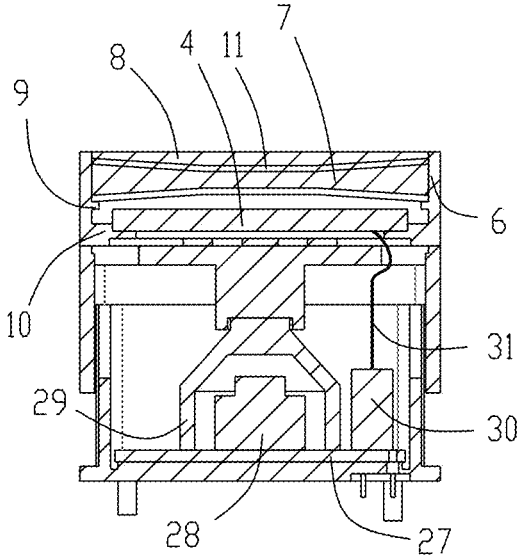
FIG. 20 is a D-D directional section view of the switch display apparatus of FIG. 19.
Figure 21:
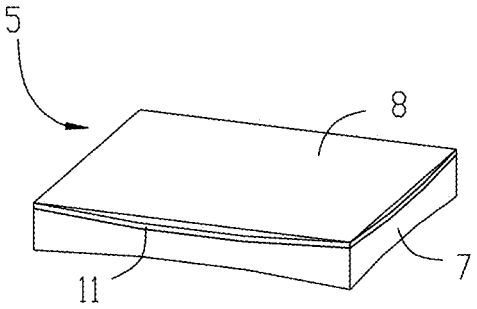
FIG. 21 is a schematic structural diagram of a combined lens in Embodiment 2 of the present disclosure.
Figure 22:
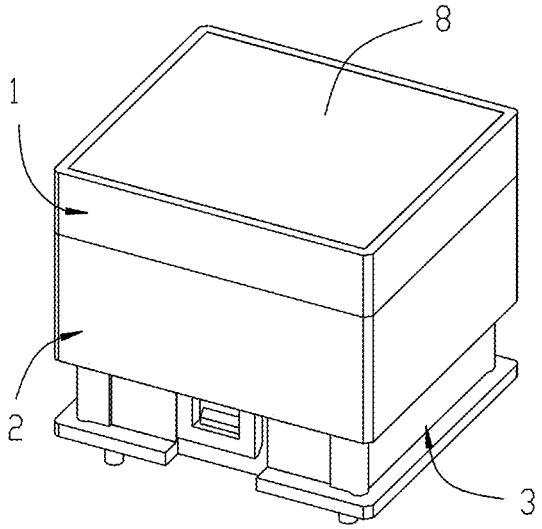
FIG. 22 is a schematic structural diagram of a switch display apparatus in Embodiment 3 of the present disclosure.
Figure 23:
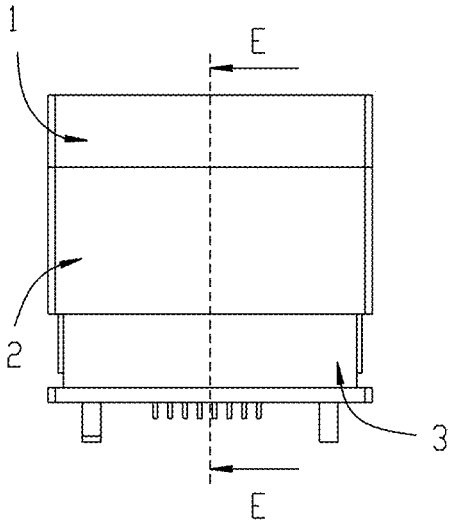
FIG. 23 is a side view of the switch display apparatus in Embodiment 3 of the present disclosure.
Figure 24:
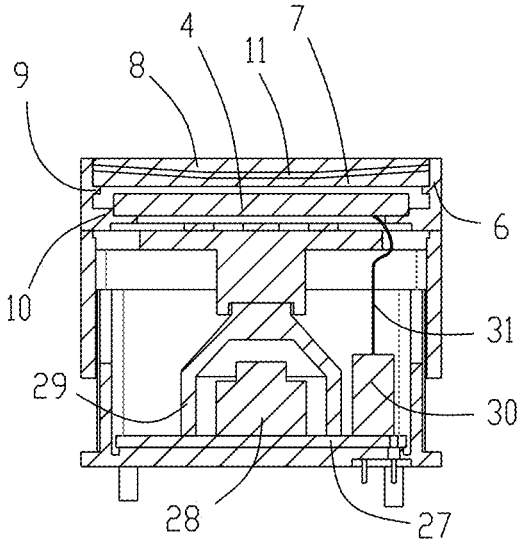
FIG. 24 is an E-E directional section view of the switch display apparatus in FIG. 19.
Figure 25:
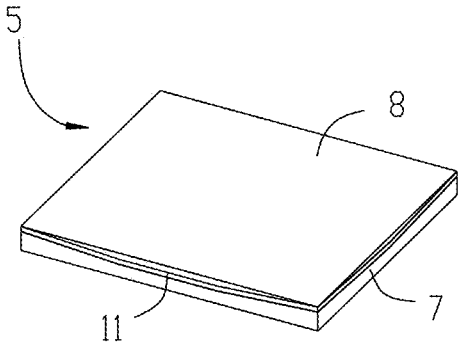
FIG. 25 is a schematic structural diagram of a combined lens in Embodiment 3 of the present disclosure.

As shown in FIG. 11 to FIG. 13, a switch cap limiting groove 24 is formed in the switch cap press seat 23, the switch cap limiting groove 24 may be square or circular, and a limiting effect is achieved when the rubber switch cap 29 extends into the switch cap limiting groove 24. As shown in FIG. 11, two buckles, for example, buckles 25, that are arranged oppositely are arranged at the bottom of the support unit side plate 20, which facilitates connecting with clamping blocks arranged on the base unit 3, and facilitating limiting the stroke of the support unit 2. As shown in FIG. 5, and FIG. 14 to FIG. 16, the base unit 3 includes a base body 26, a circuit board 27, a (metal) button switch 28, a rubber switch cap 29, a socket 30, and a connecting wire harness 31. Where, the structure of the rubber switch cap 29 is as shown in FIG. 17.

Figure 14:
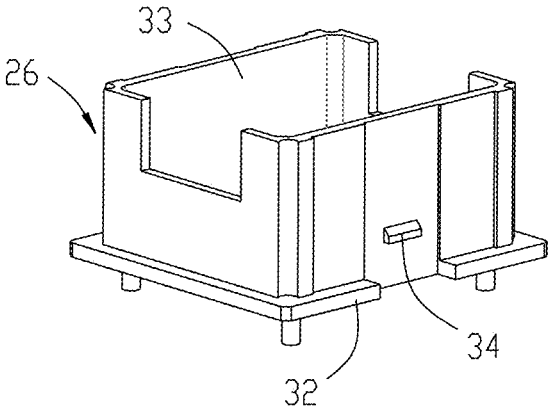
FIG. 14 is a schematic structural diagram of a base unit in Embodiment 1 of the present disclosure.

In the present embodiment, the base body 26 is preferably square, of course, the base body 26 may also be designed as a circular structure. As shown in FIG. 14, the base body 26 includes a base body bottom plate 32 and a base body side plate 33. The circuit board 27 is mounted on a base body bottom plate 32, and a button switch 28 and the socket 30 are respectively mounted on the circuit board 27. One end of the connecting wire harness 31 is connected to the socket 30, and the other end of the connecting wire harness 31 is connected to the lower surface of the display device 4 after passing through the connecting wire harness through holes 22 and the connecting wire harness through holes 17 sequentially, which is used for realizing electrical connection between the display unit 1 and the base unit 3. The rubber switch cap 29 is arranged on the button switch 28 in a sleeving manner and forms overall package for the button switch 28. The top end of the rubber switch cap 29 extends into the switch cap limiting groove 24.

In Embodiment 1, the principle for realizing electrical on-off control through a button is as follows:

When the switch display apparatus is stressed by a downward press force, the upper part of the apparatus may move downwards. An internal mechanism transfers the press force to the rubber switch cap 29 and pushes the button switch 28 to move downward to connect the two ends of the button switch 28 together to realize electrical connection. A metal pin of the apparatus transmits an on-off signal to other external equipment connected to the apparatus.

Because the rubber switch cap 29 has certain elasticity, when there is no pressure triggering, the rubber switch cap 29 bounces up and butts in the switch cap limiting groove 24. In order to limit the stroke of the up-down movement of the support unit 2, the following design is further performed: a clamping block 34 is arranged corresponding to each buckle 25 at the corresponding position on the side part of the base body side plate 33. Each buckle 25 and the corresponding clamping block 34 form a buckling unit to limit the stroke of the support unit when it moves in the up-down direction. As shown in FIG. 10, a bayonet 35 for the clamping block 34 to insert is formed in the buckle 25, and the bayonet 35, for example, is square. The length of the bayonet 35 in the up-down direction is greater than that of the clamping block 34 in the up-down direction, so as to ensure that the buckle 25 has certain amount of movement in the up-down direction. When the support unit 2 moves up and down, its stroke is constrained by the buckling unit. In addition, the present embodiment is not limited to the design of the two groups of buckle units above, and there may be three groups or more. Through the above design, the switch display apparatus in the present embodiment may realize an electrical on-off control function. The electrical on-off control function in the present embodiment is realized by pressing the button.

In the present embodiment, in order to improve the convenience of an assembling operation, after the display unit 1 and the support unit 2 are assembled together, the terminal of the connecting wire harness 31 led out from the display device 4 is plugged into the socket 30 of the circuit board 27 first, and then the circuit board 27 is integrally assembled on the base body bottom plate 32, which can effectively reduce the operation difficulty and improve the operation efficiency.

Figure 15:
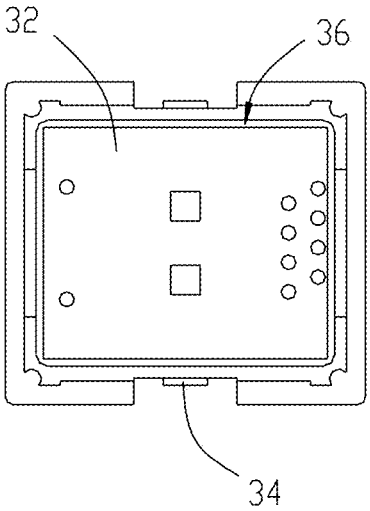
FIG. 15 is a vertical view of the base unit in Embodiment 1 of the present disclosure.

As shown in FIG. 15, in order to facilitate the mounting of the circuit board 27, an annular glue groove 36 is formed in the edge of the periphery of the base body bottom plate 32. Glue is dispensed into the annular glue groove 36 first, and then the circuit board 27 is placed on the base body bottom plate 32 for connecting. In the manner, the protection of the bottom of the inner side of the switch display apparatus may be achieved, and the waterproof and dustproof effects are good. In addition, in order to achieve a higher protection grade, concave structures are arranged at the openings in the bottom surface (namely, the outer side of the base body bottom plate 32) outside the base unit 3, as shown in FIG. 16, and are used for filling sealing glue to realize the protection of the bottom surface outside the apparatus.

The display unit 1 in the present embodiment further includes a transparent protective cover 37, as shown in FIG. 1 to FIG. 5.

The transparent protective cover 37 is located above the combined lens 5, and its connection manner is as follows: the periphery of the lower surface of the transparent protective cover 37 is glued to the corresponding position of the upper surface of the display device and combined lens support component 6.

The transparent protective cover 37 is an operation interface for a user to control the switch display apparatus, which is required to have certain structural strength and scratch resistance, and meanwhile, have the property of preventing fingerprint oil stain. The transparent protective cover 37 is also a display interface, so it is required to have good optical transmittance. Meanwhile, the transparent protective cover 37 also realizes an assembling supporting function for a lens combination, so it must have certain structural strength. In consideration of a processing process and a requirement for realizing the functions above, the transparent protective cover 37 is preferably made of glass. Compared with the existing ABS plastic material, its light transmittance is obviously improved, and moreover, the material strength is high, so it is not easy to scratch, and edges and corners are not easy to crack and damage. A film with a special function is plated on the surface of the transparent protective cover 37 by a coating process, so that the transparent protective cover 37 has good light transmittance, good structural strength, scratch resistance, and fingerprint oil stain resistance. Of course, the transparent protective cover 37 may also be made of the existing ABS plastic material, which is not described in detail here. In addition, in order to provide a better visual experience, a light-absorbing coating is arranged on the periphery of the lower surface of the transparent protective cover 37. Stray light inside the apparatus may also be blocked effectively by implementing spraying treatment on the periphery of the lower surface of the transparent protective cover 37. The sprayed medium and color are limited by effectively covering irrelevant structures and stray light inside, and a dark medium which is not easy to fade is preferred. The periphery here refers to the area, close to the outer edge (of the transparent protective cover), of the lower surface of the transparent protective cover 37. The display device 4, the combined lens 5, and the transparent protective cover 37 in the present embodiment are all connected to the display device and combined lens support component 6 through a gluing process, so the sealing property of the inner space of the display unit 1 is good, which may effectively prevent water vapor or dust from entering, solves the problems about dust proofing and water proofing of the display unit 1, and meanwhile, facilitates assembling.

In addition, in order to prevent the connecting wire harness 31 from being pulled during an assembling process, ensure the reliability of the apparatus, and improve the protection performance of the apparatus, a plugging position between the connecting wire harness 31 and the display device 4 adopts a gluing process and is sealed and cured by using the sealing glue. Meanwhile, the plugging position between the connecting wire harness 31 and the socket 30 is also sealed and cured by using the gluing process. In addition, the connecting positions of the button switch 28 and the socket 30 on the circuit board 27 are both sealed by using the gluing process. The above gluing process is beneficial to realizing the isolation between an electrical pin and outer space, so that the waterproof and dustproof grades of the switch display apparatus are obviously improved. Tests show that the protection grade of the apparatus product in the present embodiment can reach IP67. The present embodiment can realize a full screen image display function very well, and has an electrical on-off control function. In addition, there are few components and parts in the present embodiment, various parts are simple in structure and convenient to connect, so that the present embodiment has the advantages of convenience in assembling and the like.

Embodiment 2

Embodiment 2 also describes a switch display apparatus. The switch display apparatus can refer to Embodiment 1 described above except for the following technical features which are different from Embodiment 1 described above.

As shown in FIG. 18 to FIG. 21, the structure of the display unit 1 of Embodiment 2 is slightly different from that in Embodiment 1 described above, and both the structures of the support unit 2 and the base unit 3 can refer to related structures in Embodiment 1 described above. Compared with Embodiment 1 described above, the differences in structures of the display unit 1 in Embodiment 2 are that: the combined lens 5 in Embodiment 2 includes a concave lens 7 and a convex lens 8, where, the concave lens 7 adopts a biconcave lens, and the convex lens 8 adopts a planoconvex lens, where, the upper surface of the convex lens 8 is a plane layer of the planoconvex lens. The principle of optically magnifying by using the combined lens 5 in Embodiment 2 is exactly the same as that in Embodiment 1. The upper surface of the convex lens 8 is the plane layer of the planoconvex lens, so the transparent protective cover 37 is omitted in Embodiment 3, the upper surface of the convex lens 8 is coated with a coating, so the convex lens 8 has good light transmittance, and good scratch resistance and fingerprint oil stain resistance. Compared with Embodiment 1 described above, Embodiment 2 further simplifies components and parts of the switch display apparatus.

Embodiment 3

Embodiment 3 also describes a switch display apparatus. The switch display apparatus can refer to Embodiment 1 described above except for the following technical features which are different from Embodiment 1 described above. As shown in FIG. 22 to FIG. 25, the structure of the display unit 1 of Embodiment 3 is slightly different from that in Embodiment 1 described above, and both the structures of the support unit 2 and the base unit 3 can refer to related structures in Embodiment 1 described above. Compared with Embodiment 1 described above, the differences in structures of the display unit 1 in Embodiment 3 are that: the combined lens 5 in Embodiment 3 includes a concave lens 7 and a convex lens 8, where, the concave lens 7 adopts a planoconcave lens, and the convex lens 8 adopts a planoconvex lens. The upper surface of the convex lens 8 is a plane layer of the planoconvex lens, and the lower surface of the concave lens 7 is a plane layer of the planoconcave lens. The principle of optically magnifying by the combined lens 5 in Embodiment 3 is exactly the same as that in Embodiment 1. The upper surface of the convex lens 8 is the plane layer of the planoconvex lens, so the transparent protective cover 37 is omitted in Embodiment 2, the upper surface of the convex lens 8 is coated with a coating, so the convex lens 8 has good light transmittance, and good scratch resistance and fingerprint oil stain resistance. Compared with Embodiment 1 described above, Embodiment 3 further simplifies components and parts of the switch display apparatus. It should be noted that, the combination manners of various lenses in the three embodiments above have the effects of magnifying, and weakening spherical aberration and chromatic aberration. Of course, the combined lens 5 is not limited to the combination of the two lenses above. For example, the combined lens 5 may also effectively improve the edge distortion and chromatic dispersion of an image by increasing the number of lenses or adopting a non-spherical design technology, so that a better display effect is achieved.

Embodiment 4

Figure 27:
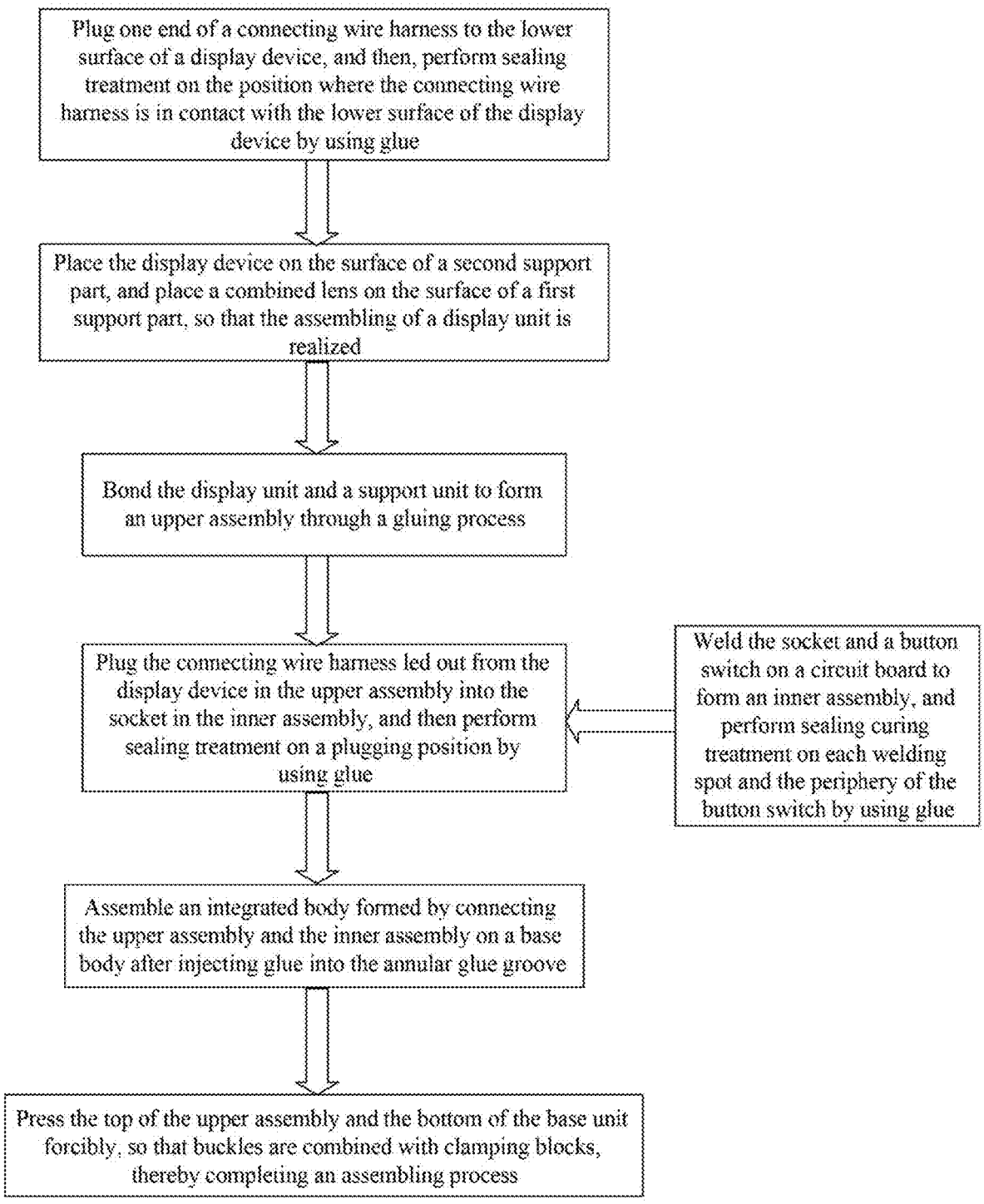
FIG. 27 is a schematic flowchart diagram of an assembling method for a switch display apparatus in Embodiment 4 of the present disclosure.
Figure 28:
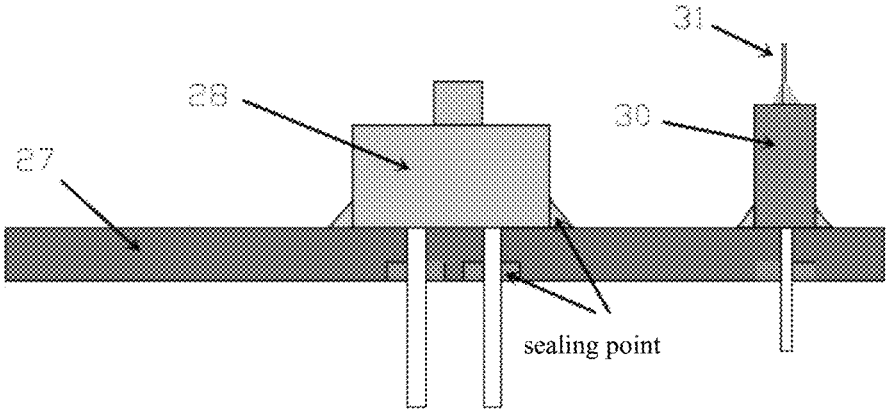
FIG. 28 is a schematic diagram of sealing of each welding spot on a circuit board and the periphery of a switch in Embodiment 4 of the present disclosure.

As shown in FIG. 27, Embodiment 4 provides an assembling method for the switch display apparatus. The assembling method is based on the switch display apparatus described in Embodiment 1, 2 or 3. Specific assembling processes are as follows: I. first, one end of the connecting wire harness 31 is plugged to the lower surface of the display device 4, and then, sealing treatment is performed on the position where the connecting wire harness 31 is in contact with the lower surface of the display device 4 by using glue. II. The surface of the second support part 10 is coated with a layer of glue, and the display device 4 is placed on the surface of the second support part 10, so that the bottom of the display device 4 and the surface of the second support part 10 are connected to each other. Then, the surface of the first support part 9 is coated with a layer of glue, and the combined lens 5 is placed on the surface of the first support part 9, so that the bottom of the combined lens 5 and the surface of the first support part 9 are connected to each other. Thus, the assembling of the display unit 1 is completed. The gluing process above is beneficial to improving the assembling convenience of the display unit. The interior sealing property of the display unit 1 is good, which is beneficial to improving the waterproof and dustproof effects of the display unit 1. If the display unit 1 further includes a transparent protective cover 37 located above the combined lens 5 (as shown in Embodiment 1 described above), then, the mounting of the transparent protective cover 37 also needs to be completed after the mounting of the combined lens 5 of the step II is completed. Specifically, the edge of the periphery of the upper surface of the display device and combined lens support component 6 is coated with a layer of glue, and then, the transparent protective cover 37 is aligned with and pressed on the edge of the periphery of the upper surface of the display device and combined lens support component 6. III. Each top plate glue groove 21 is filled with a certain amount of glue, and then the display unit 1 is pressed on the upper surface of the support unit 2 (namely, the upper surface of the support unit top plate), so that the display unit 1 and the support unit 2 are connected together to form an upper assembly. This gluing process is beneficial to improving the assembling convenience of the display unit 1 and the support unit 2. In addition, the top plate glue grooves 21 are formed in the upper surface of the support unit top plate 19, so glue overflow can be effectively avoided, the trouble in dealing with glue overflow in later period is omitted, and meanwhile, the appearance of the switch display apparatus is also ensured. IV. The socket 30 and the button switch 28 are welded on the circuit board 27 to form an inner assembly, and sealing curing treatment is performed on each welding spot and the periphery 28 of the button switch by using glue, as shown in FIG. 28. Then, the rubber switch cap 29 is arranged on the button switch 28 in a sleeving manner. V. The other end (lower end) of the connecting wire harness 31 led out from the display device 4 in the upper assembly after being connected in the step III is plugged into the socket 30 in the inner assembly after being connected by the step IV; then sealing treatment is performed on a plugging position by using glue, and thus, the upper assembly and the inner assembly are connected into an integrated body. VI. The integrated body formed by connecting the upper assembly and the inner assembly is assembled on the base body 26 after glue is injected into the annular glue groove 36. After the assembling is completed, the bottom of the base unit 3 can be ensured to have relatively high protection grade. VII. The top of the upper assembly and the bottom of the base unit 3 are pressed forcibly, so that buckles 25 are combined with clamping blocks 34, thus the overall assembling process of the switch display apparatus is completed. From the above processes, it is not difficult to see that the components and parts of the switch display apparatus in the present embodiment are obviously reduced, and the assembly process is simple, and the assembly difficulty is effectively reduced, so as to improve the assembling efficiency of the switch display apparatus. In addition, the connections between the parts of the switch display apparatus of the present embodiment mostly adopt the gluing process, which is beneficial to improving the protection grade of the switch display apparatus, and obviously improving the dustproof and waterproof effects. Of course, the above description is merely better embodiments of the present disclosure, and the present disclosure is not limited to listing the above-mentioned embodiments. It should be noted that, all equivalent substitutions and obvious deformation forms made by any person skilled in the art under the teaching of this specification fall within the substantive scope of the specification and should be protected by the present disclosure.

What is claimed is:

1. A switch display apparatus, comprising a display unit, a support unit, and a base unit that are arranged sequentially from top to bottom, wherein the display unit comprises a display device, a combined lens, and a display device and combined lens support component;

the display device is configured to provide a display image;

the combined lens is located above the display device and is configured to optically magnify the overall display image and output the optionally magnified display image;

both the display device and the combined lens are located inside the display device and combined lens support component;

the display device and combined lens support component comprises a first support part used for providing structural support for the combined lens, and a second support part used for providing structural support for the display device;

the first support part and the second support part are respectively connected to the inner side walls of the display device and combined lens support component;

the support unit comprises a support unit top plate and support unit side plates;

at least one top plate glue groove is arranged on the upper surface of the support unit top plate, wherein the top plate glue groove is strip-shaped or annular; the upper surface of the support unit top plate is connected to the bottom surface of the display device and combined lens support component;

a switch cap press seat is arranged at the central position of the lower surface of the support unit top plate;

a switch cap limiting groove is formed in the switch cap press sea;

the base unit comprises a base body, a circuit board, a button switch, a rubber switch cap, a socket, and a connecting wire harness;

the base body comprises a base body bottom plate and base body side plates;

an annular glue groove is arranged at the edge of the periphery of the base body bottom plate, and the circuit board is mounted on the base body bottom plate;

the button switch and the socket are respectively mounted on the circuit board;

one end of the connecting wire harness is connected to the socket, and the other end of the connecting wire harness is connected to the lower surface of the display device;

the rubber switch cap is arranged on the button switch in a sleeving manner and forms overall package for the button switch;

the top end of the rubber switch cap extends into the switch cap limiting groove;

at least two groups of buckle units are arranged between the support unit side plate and the base body side plate;

the buckle unit comprises a buckle mounted at the bottom of the support unit side plate and a clamping block mounted on the side part of the base body side plate; a bayonet for the clamping block to insert is arranged on the buckle; the length of the bayonet in the up-down direction is greater than that of the clamping block in the up-down direction;

connecting wire harness through holes are respectively formed in the support unit top plate and the bottom surface of the display device and combined lens support component.

2. The switch display apparatus according to claim 1, wherein the combined lens comprises a concave lens and a convex lens, wherein the concave lens is located above the display device, and the convex lens is located above the concave lens.

3. The switch display apparatus according to claim 2, wherein the combined lens further comprises an optical adhesive layer located between the concave lens and the convex lens, wherein the upper surface of the optical adhesive layer is connected to the lower surface of the convex lens; the lower surface of the optical adhesive layer is connected to the upper surface of the concave lens.

4. The switch display apparatus according to claim 2, wherein the concave lens comprises a biconcave lens or a planoconcave lens; the convex lens comprises a biconvex lens or a planoconvex lens.

5. The switch display apparatus according to claim 1, wherein the display unit further comprises a transparent protective cover located above the combined lens;

the periphery of the lower surface of the transparent protective cover is connected to the upper surface of the display device and combined lens support component.

6. The switch display apparatus according to claim 5, wherein the transparent protective cover is made of glass or an ABS plastic material.

7. The switch display apparatus according to claim 1, wherein the display device comprises a liquid crystal display screen or an LED display screen.

8. The switch display apparatus according to claim 5, wherein a light-absorbing coating is arranged on the periphery of the lower surface of the transparent protective cover.

9. The switch display apparatus according to claim 1, wherein the display device and combined lens support component comprises a support part bottom plate and support part side plates, wherein the first support part and the second support part are respectively connected to the inner side walls of the support part side plates;

the first support part adopts a support strip or support groove structure, and:

part or all edge of the lower side of the combined lens is located on the upper surface of the support strip or located inside the support groove;

the second support part adopts a support strip or support groove structure, and:

part or all edge of the lower side of the display device is located on the upper surface of the support strip or located inside the support groove.

10. An assembling method for a switch display apparatus, wherein based on the switch display apparatus according to claim 1, the assembling method comprises the following steps:

first, plugging one end of the connecting wire harness to the lower surface of the display device, and then, performing sealing treatment on the position where the connecting wire harness is in contact with the lower surface of the display device by using glue;

coating the surface of the second support part with a layer of glue, and placing the display device on the surface of the second support part, so that the bottom of the display device and the surface of the second support part are connected to each other;

then, coating the surface of the first support part with a layer of glue, and placing the combined lens on the surface of the first support part, so that the bottom of the combined lens and the surface of the first support part are connected to each other, thus the assembling of the display unit is completed;

filling a certain amount of glue into the top plate glue groove, and then pressing the display unit on the upper surface of the support unit, so that the display unit and the support unit are connected together to form an upper assembly;

welding the socket and the button switch on the circuit board to form an inner assembly, performing sealing curing treatment on each welding spot and the periphery of the button switch by using glue, and arranging the rubber switch cap on the button switch in a sleeving manner;

plugging the other end of the connecting wire harness led out from the display device in the upper assembly after being connected in the step III into the socket in the inner assembly after being connected in the step IV, and then performing sealing treatment on a plugging position by using glue, thus the upper assembly in the step III and the inner assembly in the step IV are connected into an integrated body;

assembling the integrated body formed by connecting the upper assembly and the inner assembly on the base body after injecting glue into the annular glue groove;

pressing the top of the upper assembly and the bottom of the base unit forcibly, so that buckles are combined with clamping blocks, thereby completing an assembling process.

11. An assembling method for a switch display apparatus, wherein based on the switch display apparatus according to claim 2, the assembling method comprises the following steps:

first, plugging one end of the connecting wire harness to the lower surface of the display device, and then, Performing sealing treatment on the position where the connecting wire harness is in contact with the lower surface of the display device by using glue;

coating the surface of the second su art with a layer of glue, and placing the display device on the surface of the second support part, so that the bottom of the display device and the surface of the second support part are connected to each other;

then, coating the surface of the first support part with a laver of glue, and placing the combined lens on the surface of the first support part, so that the bottom of the combined lens and the surface of the first support part are connected to each other thus the assembling of the display unit is completed;

filling a certain amount of glue into the too plate glue groove, and then pressing the display unit on the upper surface of the support unit so that the display unit and the support unit are connected together to form an upper assembly;

welding the socket and the button switch on the circuit board to form an inner assembly performing sealing curing treatment on each welding spot and the periphery of the button switch by using glue, and arranging the rubber switch cap on the button switch in a sleeving manner;

plugging the other end of the connecting wire harness led out from the display device in the upper assembly after being connected in the step III into the socket in the inner assembly after being connected in the step IV, and then performing sealing treatment on a plugging position by using glue;

thus the upper assembly in the step III and the inner assembly in the step IV are connected into an integrated body;

assembling the integrated body formed by connecting the upper assembly and the inner assembly on the base body after injecting glue into the annular glue groove;

pressing the top of the upper assembly and the bottom of the base unit forcibly so that buckles are combined with clamping blocks, thereby completing an assembling process.

12. An assembling method for a switch display apparatus, wherein based on the switch display apparatus according to claim 3, the assembling method comprises the following steps:

first, plugging one end of the connecting wire harness to the lower surface of the display device, and then, performing sealing treatment on the position where the connecting wire harness is in contact with the lower surface of the display device by using glue;

coating the surface of the second support part with a laver of glue, and placing the display device on the surface of the second support part, so that the bottom of the display device and the surface of the second support part are connected to each other;

then, coating the surface of the first support part with a laver of glue, and placing the combined lens on the surface of the first support part, so that the bottom of the combined lens and the surface of the first support part are connected to each other thus the assembling of the display unit is completed;

filling a certain amount of glue into the top late glue groove, and then pressing the display unit on the upper surface of the support unit, so that the display unit and the support unit are connected together to form an upper assembly;

welding the socket and the button switch on the circuit board to form an inner assembly, performing sealing curing treatment on each welding soot and the periphery of the button switch by using glue, and arranging the rubber switch cap on the button switch in a sleeving manner;

plugging the other end of the connecting wire harness led out from the display device in the upper assembly after being connected in the step III into the socket in the inner assembly after being connected in the step IV, and then performing sealing treatment on a plugging position by using glue, thus the upper assembly in the step III and the inner assembly in the step IV are connected into an integrated body;

assembling the integrated body formed by connecting the upper assembly and the inner assembly on the base body after injecting glue into the annular glue groove;

pressing the top of the upper assembly and the bottom of the base unit forcibly, so that buckles are combined with clamping blocks, thereby completing an assembling process.

13. An assembling method for a switch display apparatus, wherein based on the switch display apparatus according to claim 4, the assembling method comprises the following steps:

first plugging one end of the connecting wire harness to the lower surface of the display device, and then, performing sealing treatment on the position where the connecting wire harness is in contact with the lower surface of the display device by using glue;

coating the surface of the second support part with a laver of glue, and placing the display device on the surface of the second support art so that the bottom of the display device and the surface of the second support part are connected to each other;

then, coating the surface of the first support part with a laver of glue, and placing the combined lens on the surface of the first support part, so that the bottom of the combined lens and the surface of the first support part are connected to each other, thus the assembling of the display unit is completed;

filling a certain amount of glue into the top late glue groove and then pressing the display unit on the upper surface of the support unit, so that the display unit and the support unit are connected together to form an upper assembly;

welding the socket and the button switch on the circuit board to form an inner assembly, performing sealing curing treatment on each welding soot and the periphery of the button switch by using glue, and arranging the rubber switch cap on the button switch in a sleeving manner;

plugging the other end of the connecting wire harness led out from the display device in the upper assembly after being connected in the step III into the socket in the inner assembly after being connected in the step IV, and then performing sealing treatment on a plugging position by using glue;

thus the upper assembly in the step III and the inner assembly in the step IV are connected into an integrated body;

assembling the integrated body formed by connecting the upper assembly and the inner assembly on the base body after injecting glue into the annular glue groove;

pressing the too of the upper assembly and the bottom of the base unit forcibly, so that buckles are combined with clamping blocks, thereby completing an assembling process.

14. An assembling method for a switch display apparatus, wherein based on the switch display apparatus according to claim 5, the assembling method comprises the following steps:

first, plugging one end of the connecting wire harness to the lower surface of the display device, and then, performing sealing treatment on the position where the connecting wire harness is in contact with the lower surface of the display device by using glue;

coating the surface of the second support part with a laver of glue, and placing the display device on the surface of the second support part, so that the bottom of the display device and the surface of the second support part are connected to each other;

then, coating the surface of the first support part with a layer of glue and placing the combined lens on the surface f the first support part so that the bottom of the combined lens and the surface of the first support part are connected to each other thus the assembling of the display unit is completed;

filling a certain amount of glue into the top plate glue groove, and then pressing the display unit on the upper surface of the support unit, so that the display unit and the support unit are connected together to form an upper assembly;

welding the socket and the button switch on the circuit board to form an inner assembly, performing sealing curing treatment on each welding spot and the periphery of the button switch by using glue, and arranging the rubber switch ca on the button switch in a sleeving manner;

plugging the other end of the connecting wire harness led out from the display device in the upper assembly after being connected in the step III into the socket in the inner assembly after being connected in the step IV, and then performing sealing treatment on a plugging position by using glue;

thus the upper assembly in the step III and the inner assembly in the step IV are connected into an integrated body;

assembling the it rated body formed by connecting the upper assembly and the inner assembly on the base body after injecting glue into the annular glue groove;

pressing the too of the upper assembly and the bottom of the base unit forcibly, so that buckles are combined with clamping blocks, thereby completing an assembling process.

15. An assembling method for a switch display apparatus, wherein based on the switch display apparatus according to claim 6, the assembling method comprises the following steps:

first, plugging one end of the connecting wire harness to the lower surface of the display device, and then, performing sealing treatment on the position where the connecting wire harness is in contact with the lower surface of the display device by using glue;

coating the surface of the second support part with a laver of glue, and placing the display device on the surface of the second support part, so that the bottom of the display device and the surface of the second support part are connected to each other;

then, coating the surface of the first support cart with a laver of glue and placing the combined lens on the surface of the first support part so that the bottom of the combined lens and the surface of the first support art are connected to each other, thus the assembling of the display unit is completed;

filling a certain amount of glue into the top plate glue groove, and then pressing the display unit on the upper surface of the support unit so that the di pa unit and the support unit are connected together to form an upper assembly;

welding the socket and the button switch on the circuit board to form an inner assembly, Performing sealing curing treatment on each welding soot and the periphery of the button switch by using glue, and arranging the rubber switch cap on the button switch in a sleeving manner;

plugging the other end of the connecting wire harness led out from the display device in the upper assembly after being connected in the step III into the socket in the inner assembly after being connected in the step IV, and then performing sealing treatment on a plugging position by using glue;

thus the upper assembly in the step III and the inner assembly in the step IV are connected into an integrated body;

assembling the integrated body formed by connecting the upper assembly and the inner assembly on the base body after injecting glue into the annular glue groove;

pressing the to of the upper assembly and the bottom of the base unit forcibly, so that buckles are combined with clamping blocks, thereby completing an assembling process.

16. An assembling method for a switch display apparatus, wherein based on the switch display apparatus according to claim 7, the assembling method comprises the following steps:

first, plugging one end of the connecting wire harness to the lower surface of the display device, and then, performing sealing treatment on the position where the connecting wire harness is in contact with the lower surface of the display device by using glue;

coating the surface of the second support art with a layer of glue and placing the display device on the surface of the second support part, so that the bottom of the display device and the surface of the second support part are connected to each other;

then, coating the surface of the first support cart with a laver of glue and placing the combined lens on the surface of the first support part so that the bottom of the combined lens and the surface of the first support part are connected to each other, thus the assembling of the display unit is completed;

filling a certain amount of glue into the top plate glue groove, and then pressing the display unit on the upper surface of the support unit, so that the display unit and the support unit are connected together to form an upper assembly;

welding the socket and the button switch on the circuit board to form an inner assembly, performing sealing curing treatment on each welding spot and the periphery of the button switch by using glue, and arranging the rubber switch ca on the button switch in a sleeving manner;

plugging the other end of the connecting wire harness led out from the display device in the upper assembly after being connected in the step III into the socket in the inner assembly after being connected in the step IV, and then performing sealing treatment on a plugging position by using glue;

thus the upper assembly in the step III and the inner assembly in the step IV are connected into an integrated boy;

assembling the integrated body formed by connecting the upper assembly and the inner assembly on the base body after injecting glue into the annular glue groove;

pressing the top of the upper assembly and the bottom of the base unit forcibly, so that buckles are combined with clamping blocks, thereby completing an assembling process.

17. An assembling method for a switch display apparatus, wherein based on the switch display apparatus according to claim 8, the assembling method comprises the following steps:

first, plugging one end of the connecting wire harness to the lower surface of the display device, and then, performing sealing treatment on the position where the connecting wire harness is in contact with the lower surface of the display device by using glue;

coating the surface of the second support part with a layer of glue, and placing the display device on the surface of the second support part, so that the bottom of the display device and the surface of the second support part are connected to each other;

then, coating the surface of the first support part with a layer of glue, and placing the combined lens on the surface of the first support part, so that the bottom of the combined lens and the surface of the first support part are connected to each other, thus the assembling of the display unit is completed;

filling a certain amount of glue into the top plate glue groove, and then pressing the display unit on the upper surface of the support unit so that the display unit and the support unit are connected together to form an upper assembly;

welding the socket and the button switch on the circuit board to form an inner assembly, performing sealing curing treatment on each welding soot and the periphery of the button switch by using glue, and arranging the rubber switch cap on the button switch in a sleeving manner;

plugging the other end of the connecting wire harness led out from the display device in the upper assembly after being connected in the step III into the socket in the inner assembly after being connected in the step IV, and then performing sealing treatment on a plugging position by using glue;

thus the upper assembly in the step III and the inner assembly in the step IV are connected into an integrated body;

assembling the integrated body formed by connecting the upper assembly and the inner assembly on the base body after injecting glue into the annular glue groove;

pressing the too of the upper assembly and the bottom of the base unit forcibly, so that buckles are combined with clamping blocks, thereby completing an assembling process.

18. An assembling method for a switch display apparatus, wherein based on the switch display apparatus according to claim 9, the assembling method comprises the following steps:

first, plugging one end of the connecting wire harness to the lower surface of the display device, and then, performing sealing treatment on the position where the connecting wire harness is in contact with the lower surface of the display device by using glue;

coating the surface of the second support part with a layer of glue, and placing the display device on the surface of the second support part, so that the bottom of the display device and the surface of the second support part are connected to each other;

then, coating the surface of the first support part with a laver of glue, and placing the combined lens on the surface of the first support part, so that the bottom of the combined lens and the surface of the first support part are connected to each other thus the assembling of the display unit is completed;

filling a certain amount of glue into the too plate glue groove, and then pressing the display unit on the upper surface of the support unit so that the display unit and the support unit are connected together to form an upper assembly;

welding the socket and the button switch on the circuit board to form an inner assembly performing sealing curing treatment on each welding spot and the periphery of the button switch by using glue, and arranging the rubber switch cap on the button switch in a sleeving manner;

plugging the other end of the connecting wire harness led out from the display device in the upper assembly after being connected in the step III into the socket in the inner assembly after being connected in the step IV, and then performing sealing treatment on a plugging position by using glue;

thus the upper assembly in the step III and the inner assembly in the step IV are connected into an integrated body;

assembling the intergrated body formed by connecting the upper assembly and the inner assembly on the base body after injecting glue into the annular glue groove;

pressing the top of the upper assembly and the bottom of the base unit forcibly, so the buckles are combined with clamping block, thereby completing an assembling process.

* * * * *